United States Patent [19]

Mansour

[11] Patent Number: 4,520,750

[45] Date of Patent: Jun. 4, 1985

[54] GAS CURING CHAMBER FOR FLAT SUBSTRATES

[75] Inventor: Maher L. Mansour, Columbus, Ohio

[73] Assignee: Ashland Oil, Inc., Ashland, Ky.

[21] Appl. No.: 665,936

[22] Filed: Oct. 29, 1984

Related U.S. Application Data

[62] Division of Ser. No. 544,364, Oct. 21, 1983, Pat. No. 4,491,610.

[51] Int. Cl.[3] ..... F26B 15/12; F26B 19/00; F26B 25/00

[52] U.S. Cl. ..... 118/58; 34/212; 34/213; 34/216; 34/217; 34/242

[58] Field of Search ..... 34/212, 213, 216, 217, 34/242; 118/429, 58

[56] References Cited

U.S. PATENT DOCUMENTS 3,851,402 12/1974 Turnbull et al. ..... 34/242 X
3,931,684 1/1976 Turnbull et al. ..... 34/242
4,294,021 10/1981 Turnbull et al. ..... 34/224

*Primary Examiner*—Michael R. Lusignan
*Attorney, Agent, or Firm*—Mueller and Smith

[57] ABSTRACT

Disclosed is a chamber which defines a constant gas flow environment for passing objects therethrough carried by a conveyor. The chamber comprises an elongate housing having an inlet opening and an outlet opening in the longitudinal direction and a moving conveyor which runs the length of said housing for transporting object from said inlet opening through said housing and thereout through said outlet opening, the space below said conveyor being enclosed and connected to a source of exhaust for exhausting gaseous substances therein. The space above the conveyor comprises an inlet zone, a central gas zone, and an outlet zone. The inlet zone and the outlet zone both are of a bi-cameral containment arrangement comprising an outer adjustable gate for determining the inlet opening, a central adjustable baffle gate, and an inner deflector wall. The space between the outer gate and the baffle gate is connected to a source of exhaust. The space between the baffle gate and the deflector wall is a modulating gas cell which contains a gas knife connected to a source of inert gas and capable of injecting said inert gas at an adjustable angle onto the conveyor substantially its entire width. The central gas flow zone operates under external recycle of its atmosphere in a direction countercurrent to the direction of the conveyor belt which passes therethrough. The chamber is ideally suited for vapor permeation curing of flat substrates coated with a vapor permeation curable coating.

15 Claims, 7 Drawing Figures

GAS CURING CHAMBER FOR FLAT SUBSTRATES

This application is a division, of application Ser. No. 6/544,364, filed Oct. 21, 1983, now U.S. Pat. No. 4,491,610, patented Jan. 1, 1985.

BACKGROUND OF THE INVENTION

The present invention relates to vapor permeation curable coating compositions and more particularly to a curing chamber with constant gas flow environment which is designed especially to cure said coating compositions.

Vapor permeation curable coatings are a class of coatings formulated from aromatic-hydroxyl functional polymers and multi-isocyanate cross-linking agents wherein an applied film thereof is cured by exposure to a vaporous tertiary amine catalyst. In order to contain and handle the vaporous tertiary amine catalyst economically and safely, curing chambers have been developed. Generally, such curing chambers are substantially empty, rectangular boxes through which a conveyor bearing the coated substrate passes. Provision is made for entrance and exit of vaporous tertiary amine, normally borne by an inert gas carrier such as nitrogen or carbon dioxide, for example, and means are provided at the inlet and outlet of the chamber to enhance containment of the vaporous tertiary amine catalyst within the chamber. The inlet and outlet containment means further restrict the entrance of oxygen into the chamber because oxygen can create an explosive condition with the vaporous tertiary amine catalyst. Cure of such coatings is so rapid that no external source of heat is required.

Representative examples of past curing chambers are set forth in U.S. Pat. Nos. 3,851,402, 3,931,684, and 4,294,021. Of particular note in the patented curing chambers is the provision made at the inlet and outlet for containment of the vaporous tertiary amine curing gas within the chamber. For example, U.S. Pat. Nos. 3,851,402 and 3,931,684 provide moist air curtains at the inlet and outlet which moist air curtains along with a source of suction are designed to minimize escape of tertiary amine gas from within the chamber. Somewhat different is the design in U.S. Pat. No. 4,294,021 which calls for the exhaust fan to create a slight negative pressure to induce gas flow within the chamber in the direction of the exhaust duct which is located near the exit of the chamber. It is noted by the patentees that air is dragged by the conveyor from the inlet and such flow of air along with the vaporous amine circulates from the entrance of the chamber to the exhaust duct where the gas is withdrawn for recirculation. The patentees further note that the negative pressure created at the exhaust duct near the outlet also creates a flow of air from the exhaust end of the chamber into the chamber itself. No provision in this patent is seen for minimizing air flow into the chamber and, to the contrary, the design appears to encourage the flow of air into the chamber.

While prior curing chambers certainly have performed adequately in the marketplace, many problems exist with prior designs. One problem with prior designs is the loss of amine vapor. Another problem is the inability to prevent air from entering into the curing portion of the chamber. A further disadvantage is the inability to operate at rapid conveyor belt speeds. The present invention addresses these and other deficiencies in the prior art and provides a unique chamber as will be more fully appreciated by the description contained below.

BROAD STATEMENT OF THE INVENTION

The present invention is directed to a curing chamber which defines a constant gas flow environment for passing objects therethrough carried by transporting or conveyor means, such as a conveyor. The chamber is ideally suited for vapor permeation curing of flat substrates carried by the conveyor. The chamber comprises an elongate housing having an inlet opening and an outlet opening in the longitudinal direction and a moving conveyor, which preferably is an endless conveyor, which runs the length of the housing for transporting objects from the inlet opening through said housing and out of said chamber through said outlet opening. The space below the conveyor is enclosed and is connected to a source of exhaust for exhausting gaseous substances therein. The space above the conveyor comprises an inlet zone, a central gas flow zone, and an outlet zone. The inlet zone comprises an outer inlet adjustable gate for determining the inlet opening, a middle inlet adjustable baffle gate, and an inner inlet deflector wall. The space between the outer gate and the inlet baffle gate is connected to exhaust means. The space between the inlet baffle gate and the inner inlet deflector wall is a modulating gas cell which contains a gas knife connected to a source of inert gas. The gas knife is capable of injecting the inert gas at an adjustable angle onto the conveyor substantially the entire width of the conveyor. The outlet zone comprises an adjustable outer gate which determines the outlet opening, a middle outlet adjustable baffle gate, and an inner outlet deflector wall. The space between the outer outlet gate and the middle outlet baffle gate also is connected to exhaust means. Preferably, the enclosed space between each outer gate and each baffle gate is maintained at substantially the same pressure within the inlet zone and the outlet zone which pressure typically is slightly less than atmospheric pressure. The space between the inner outlet baffle gate and the inner outlet deflector wall in the outlet zone also is a modulating gas cell which contains a gas knife. The outlet gas knife also is connected to a source of inert gas which is capable of injecting the inert gas at an adjustable angle onto the conveyor substantially the entire width of the conveyor.

The central gas zone has withdrawal means located in proximity to the inlet deflector wall which withdrawal means are connected to recirculating means for passing gaseous flow back into said central gas zone. The recirculating flow is passed back into the central flow zone at a location in proximity to the inner outlet deflector wall. Both the inlet and outlet deflector walls are sloped downwardly and inwardly. Preferably, such sloped surfaces are smooth and curvilinear.

Advantages of the present invention include the ability to maintain a gas composition substantially constant even at relatively high conveyor belt speeds. Another advantage is the ability to effectively exclude oxygen, i.e. air, from the interior of the curing chamber. A further advantage is the minimization of losses of gas, e.g. a tertiary amine or the like in vapor permeation curing adaptations of the invention, which contributes to the efficiency and economy of the design of the curing chamber. A further advantage is the conservation of inert diluent gas advantageously used in connection with vapor permeation cure adaptations of the present invention. These and objects will be readily apparent to those skilled in the art based upon the disclosure contained herein.

These drawings will be described in detail in connection with the description of the invention which follows.

DETAILED DESCRIPTION OF THE INVENTION

The curing chamber of the present invention comprises several unique aspects which operate conjunctively to the overall efficiency and economy of the curing chamber for containment of a constant gas flow environment to the exclusion of the ambient atmosphere. These conditions are maintained while a conveyor is passed through the curing chamber at a relatively high speed. Unique design concepts implemented in the novel curing chamber of the present invention include the bicameral containment sections at the inlet and outlet, the use of fully adjustable gas knives, and the countercurrent flow circuit within the central gas zone. Such design concepts, while dominant in the process, are not limitative of the unique, and often subtle, features embodied within the curing chamber.

Figure 1:
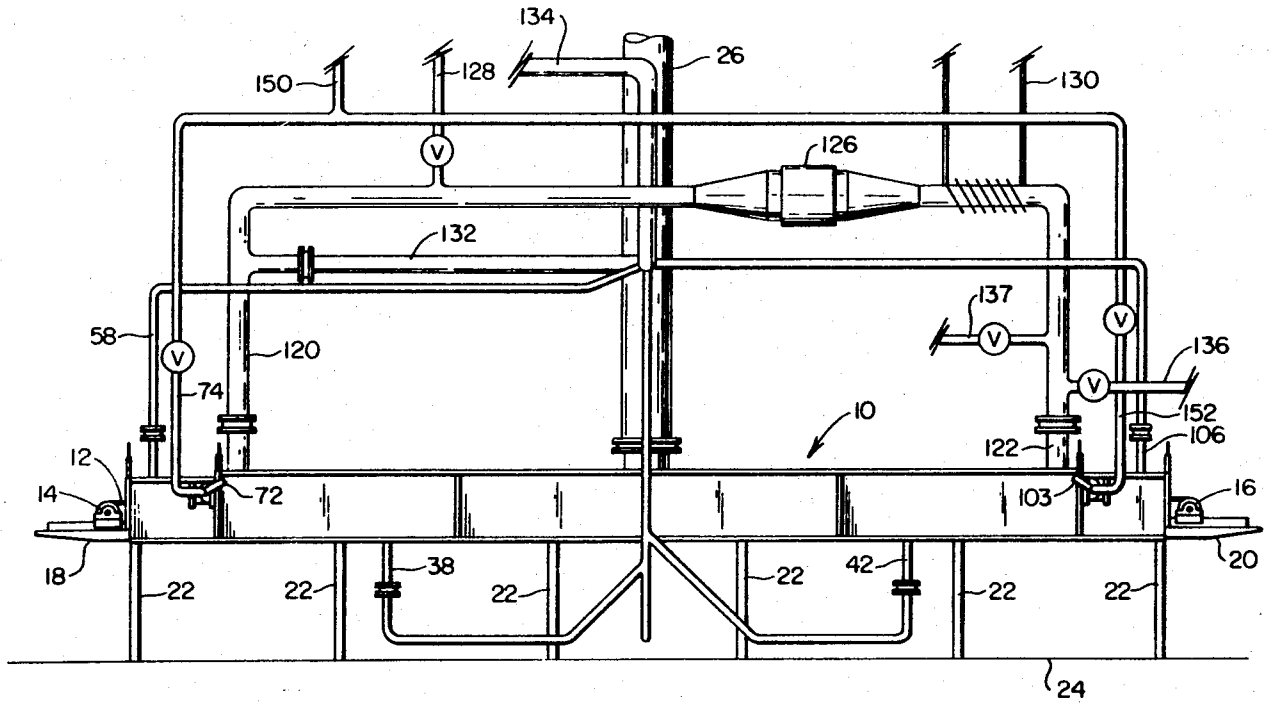
FIG. 1 is a side elevation view of a prototype curing chamber of the present invention fitted with an endless conveyor.

Referring to FIG. 1, curing chamber 10 is seen fitted with conveyor 12 driven by motor 16 at the outlet of chamber 10 with follower 14 at the inlet of chamber 10. Follower 14 rests upon frame 18 while motor 16 rests upon frame 20. Chamber 10 is designed for having flat substrates passed therethrough on conveyor 12 which rests upon slide plate 44. The curing chamber, as depicted in the drawings as noted above, is a prototype having endless conveyor belt 12 being 30.48 cm (1 foot) in width and an overall inside width of about 40.64 cm (16 inches). For present purposes, conveyor is used in a generic sense to mean any suitable means for conveying or transporting a coated substrate through the chamber for its curing. The entire length of chamber 10 is about 7.32 meters (24 feet) and its height is about 50.8 cm (20 inches). Chamber 10 is supported by a series of struts 22 which place the bottom of housing 8 of chamber 10 about 0.92 meter (3 feet) above the level of floor 24. One of the safety features fitted onto chamber 10 is emergency vent 26 which is fitted with an internal blow out diaphragm in conventional fashion. Should undesirable pressures build up within chamber 10 or an explosive condition be created therein, the safety diaphragm would rupture and the contents of chamber 10 would be immediately vented through line 26. Many other safety features are incorporated into the design of the prototype chamber depicted in the drawings and these features will be noted as the description of the drawings unfolds. The remaining piping depicted in FIG. 1 will be described in detail in connection with the description of the remaining drawings.

Referring now to the unique bi-cameral containment arrangement of the curing chamber, it must be recognized that the essence of the bicameral containment arrangement is effectively identical for the inlet section as for the outlet section. While both bi-cameral inlet zone 30 and bi-cameral outlet zone 32 operate to exclude oxygen and retain a desired internal atmosphere, it should be recognized that conveyor 12, especially at higher belt speeds, will drag atmosphere from the outside to within chamber 10. Thus, the primary focus of inlet bi-cameral zone 30 is to prevent such entering atmosphere from passing into central gas zone 34 and the primary function of bi-cameral outlet zone 32 is to prevent the escape of the atmosphere within central gas zone 34 from being dragged by conveyor 12 to the outside. With respect to containment of the atmosphere within central gas zone 34, it should be noted that, depending upon the material of construction of endless conveyor 12, such conveyor may have a tendency to absorb or adsorb the particular gaseous environment maintained within central flow zone 34. Chamber 10 is fitted with extended, elongate hood 36 which houses the return loop of endless conveyor 12. Hood 36 is formed by the lower half of housing 8 and conveyor slide plate 44. Hood 36 is connected to a source of exhaust which removes components contained within hood 36 through outlet pipes 38, 40, and 42. Should any leakage between central flow zone 34 and hood 36 develop, the withdrawal suction placed thereon would prevent such leakage from finding its way to the atmosphere. It is to be noted that when using a tertiary amine for vapor permeation curing purposes of chamber 10, often the exhaust lines such as lines 38, 40, and 42, for example, would be passed through an appropriate scrubber, e.g. an acid, for scrubbing the amine from such flow. Other gaseous components desirably utilized in chamber 10 similarly may require scrubbing so that the withdrawal lines can be piped directly to scrubbers, vented to the atmosphere, or utilized in a by-product process as is necessary, desirable, or convenient in conventional fashion.

Returning to FIG. 2, inlet bi-cameral zone 30 is divided into outer cell 50 and inner cell 52. Outer cell 50 is defined by adjustable outer footed gate 54 and centrally located bi-footed, stationary gate 56. Outer footed gate 54 is adjustable vertically to define the opening of the chamber so that substrates of varying heights can be accommodated. Outer cell 50 is connected to a source of suction through line 58 which is shown in FIG. 1 to be connected to exhaust header 134 along with exhaust lines 38, 40, and 42. Exhaust line 58 maintains cell 50 at a total pressure of slightly less than the prevailing environmental atmospheric pressure. Oxygen or air which enters into chamber 10 desirably will be withdrawn from cell 50 via line 58 in order to prevent its entrance into central gas zone 34. The footed arrangement on gates 54 and 56 again tend to suppress gaseous flow as part of the integrated containment design of the curing chamber of the present invention. Inner cell 52 is defined by central stationary bi-footed gate 56 and adjustable inner footed gate 60 which bears deflector wall 64. Gate 60 is adjustable vertically for accommodation of substrates of varying thicknesses as is outer gate 54. Central fixed bi-footed baffle gate 56, which also may be adjustable, and inner adjustable gate 60 define modulating gas cell 52. Cell 52 desirably functions as a modulating or compression zone to provide a desirable transition between outer exhaust cell 50 and interior central gas zone 34.

Figure 3:
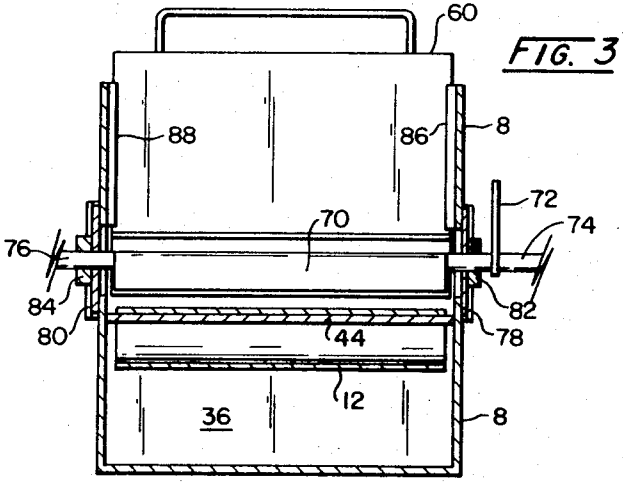
FIG. 3 is a cutaway view of the gas knife assembly located both at the inlet and at the outlet ends of the chamber.
Figure 4:
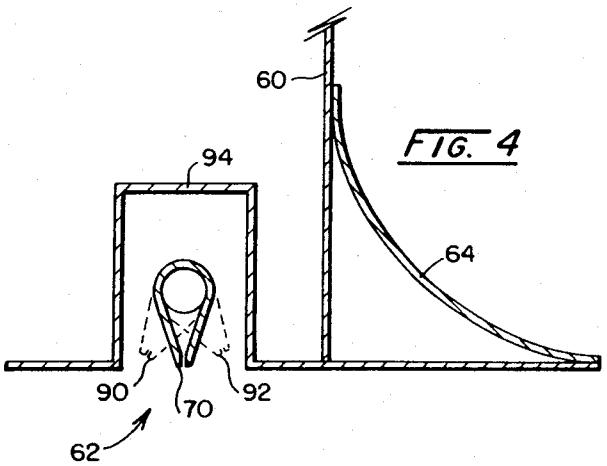
FIG. 4 is an enlarged side elevation view showing the details of the gas knife assembly.

Referring to FIG. 4, gas knife 70 is adjustable by handle 72 (see FIG. 3). From FIG. 3, it can be seen that gas knife 70 runs substantially the entire width of belt 12 and is connected to a source of inert gas from both sides through lines 74 and 76. Plates 78 and 80 have holes extending therethrough for permitting pipes 74 and 76, respectively, to pass therethrough to gas knife 70. Sealing of inert gas pipes 74 and 76 is accomplished via gaskets 82 and 84, respectively, Also, plate 78 bears a protractor for determining the angle at which gas knife 70 incidences upon conveyor belt 12. From FIG. 3 it can be seen that adjustable gate 60 is retained within guides 86 and 88 which are on both sides of gate 60 for providing a recessed track for gate 60 to follow. A flow of inert gas, e.g. nitrogen, carbon dioxide, or the like (supplied from line 150), flows through gas knife 70 through the lower slit which measures about 0.0635 mm (0.0025 inch) or less and faces belt 12 at an angle as depicted by its position 90 in FIG. 4. The angle at which knife 70 contacts belt 12, while being adjustable between 0° and 50°, has been found to advantageously range from about 10° to about 20° based upon several factors which will be elucidated in more detail below. Knife 70 is retained within gas knife housing 94 as shown in FIG. 4. Inner cell 52 desirably predominates in an inert gas composition provided by gas knife 70 and is the transition from oxygen-rich outer cell 50 and oxygen-starved central gas zone 34. The momentum of the inert gas flow through gas knife 70 is adjusted (flow rate and angle) to balance the momentum of the air layer on belt 12 and, thus, control the oxygen level in central zone 34.

Figure 2:
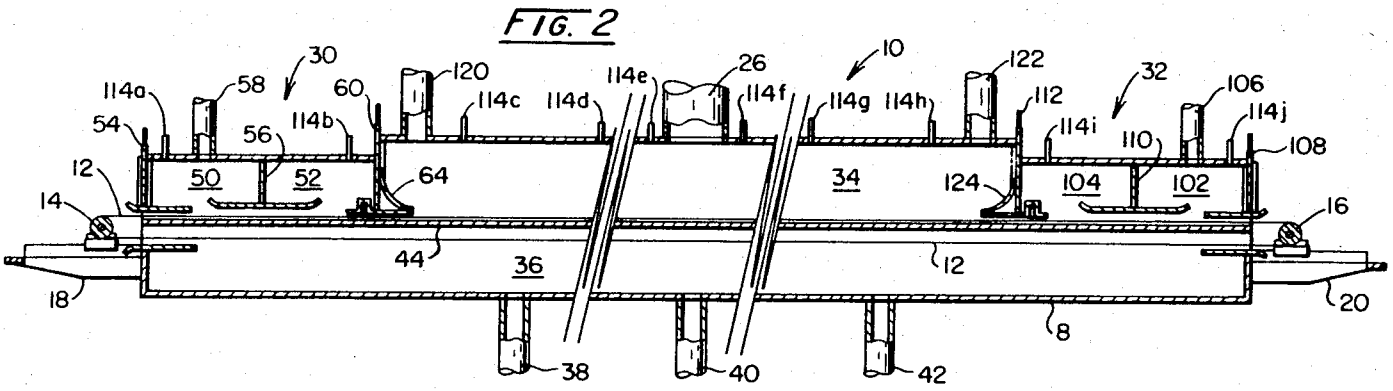
FIG. 2 is a side elevation view of the chamber of FIG. 1 sectioned through the center of the chamber in the longitudinal direction.

Outlet bi-cameral zone 32 similarly is divided into outer cell 102 and inner cell 104. Outer cell 102 is connected to a source of suction via line 106 as is outer cell 50. Cell 102 is defined by outlet adjustable footed gate 108 and central stationary bi-footed baffle gate 110. The pressures within cells 50 and 102 desirably are maintained to be the same. Inner compression cell 104 is defined by baffle gate 110 and inner adjustable gate 112. The arrangement of inner adjustable gate 112 is identical to inner gate 60 as previously described for inlet bi-cameral zone 30, i.e. as described in FIGS. 3 and 4. In this instance, however, the gas knife (supplied via line 152) for bi-cameral outlet zone 32 is adjustable by handle 103 and faces conveyor 12 at an angle contra the direction of the conveyor (i.e. as position 92 in FIG. 4 assuming FIG. 4 was a view of gate assembly 112 from the opposite side of chamber 10 as shown in FIG. 2). The angle of the outlet knife generally ranges from about 20° to 45° based upon several factors which will be set forth below. The construction of assembly 112 also is identical to the construction as described in FIG. 3 for gate assembly 60. Operation of bi-cameral outlet zone 32 again is identical to that as described in detail for inlet bi-cameral zone 30 and will not be dwelled upon further. It should be noted at this juncture of the discussion that the pressure and/or gas composition within any zone or cell of chamber 10 is determined by use of sampling ports **114*a*–114*j***.

Central gas flow zone 34 has a gas flow contained therein which is in countercurrent relationship to the direction of movement of endless conveyor belt 12. Such gas flow movement is provided by gas flow withdrawal line 120 which is located in proximity to bi-cameral inlet zone 30 and return line 122 which is located in proximity to bi-cameral outlet zone 32. The direction of movement of the gas through zone 34 is assisted by deflector walls 64 and 124 which are borne by inner gate assemblies 60 and 112, respectively. The gas flow movement, velocity, and direction is determined by in-line fan or blower 126 (see FIG. 1). Additional make-up gas, e.g. tertiary amine catalyst, is provided through line 128 which enters withdrawal line 120 as shown in FIG. 1. This arrangement permits intimate mixing of the flows through lines 120 and 128 by blower 126. Line 122 immediately following blower 126 is heated by line 130 which desirably can be a steam line, heated tape, or any similar desirable conventional heating system. For use of a vaporous tertiary amine catalyst, for example, it is desirable to provide such heating in order to ensure the vaporous phase of the tertiary amine catalyst and to prevent condensation of such catalyst. For use of different gases in chamber 10, it may be desirable to provide a source of cooling rather than heating through line 130. Similarly, line 128 may be heated for a vaporous tertiary amine catalyst or cooled for other gases in conventional fashion. Another feature of the chamber is that inert gas is provided through line 137 to the chamber to maintain a slightly higher pressure in central zone 34 than in inlet zone 30 and outlet zone 32 in order to minimize the infiltration of air (oxygen) into central zone 34. The oxygen conentration in zone 34 also can be maintained at a desired level by supplying nitrogen through lines 137 and 122 to zone 34. As noted above, additional safety features included into the prototype curing chamber in the drawings include line 132 (FIG. 1) extending from line 120. Line 132 is connected to the source of suction provided through exhaust header 134. Line 132 can be automatically activated for evacuation of the contents of central zone 34. Another safety feature is inert gas line 136 (FIG. 1) which flows into line 122. Line 136 can have a flow of inert gas immediately passed into line 122 and thence into central gas zone 34 should the level of oxygen, for example, become too high and a potentially explosive condition be imminent.

Operationally, extensive testing and observation of the prototype curing chamber of the drawings has permitted qualitative analysis of variables determinative of efficient operation of the chamber and quantification of such variables. Optimization of such variables even has been determined to a large extent based upon the data accumulated. The prototype curing chamber was operated under vapor permeation cure conditions utilizing triethylamine (TEA) vapor catalyst borne by nitrogen as the carrier gas. Nitrogen flow also was utilized for the gas knives. The data generated is accurate for the chamber design substantially independent of the particular gas components evaluated. Data collected included the belt velocity, the recycle volume, the composition of TEA and oxygen in chamber 34, the flow of inert gas through and incident angle of both the inlet and outlet gas knives, and the total consumption of TEA and nitrogen in the system. In addition to the data collected and tabulated, many of the variables were varied while others remained constant in order to assess their impact on the operation of the chamber. These variations will appear as observations following the tables below. All gas flows rates are standardized for a temperature of 15.6° C. and 1 atmosphere.

TABLE 1

| Run No. | Belt Vel. (m/min) | Recycle (L/min) | Chamber (vol %) TEA | Chamber (vol %) $O_2$ | Inlet Knife Flow (L/min) | Inlet Knife Angle (deg) | Outlet Knife Flow (L/min) | Outlet Knife Angle (deg) | TEA Consumption (Kg/hr) |
|---|---|---|---|---|---|---|---|---|---|
| 1 | 24.4 | 1500 | 1.60 | 4.0 | 31.1 | 10 | 42.5 | 25 | 0.34 |
| 2 | 82.4 | 1415 | 2.20 | 5.7 | 31.1 | 10 | 53.8 | 45 | 0.69 |
| 3 | 91.5 | 1500 | 2.86 | 5.0 | 31.1 | 20 | 53.2 | 45 | 0.74 |
| 4 | 91.5 | 1500 | 4.05 | 5.6 | 31.1 | 20 | 53.2 | 45 | 1.34 |

Observations

As a general trend, as the desired TEA concentration in the chamber is increased, so is the TEA consumption (loss) increased. On runs 3 and 4, an increase of the inlet knife (70) angle to 30° or a decrease of the inlet knife (70) angle to 10° resulted in an increase of oxygen concentration within zone 34. Also, with a lower volume of nitrogen flowing through the outlet knife, the oxygen concentration in its chamber increased.

TABLE 2

| Run No. | Belt Vel. (m/min) | Recycle (L/min) | Chamber (vol %) TEA | Chamber (vol %) $O_2$ | Inlet Knife Flow (L/min) | Inlet Knife Angle (deg) | Outlet Knife Flow (L/min) | Outlet Knife Angle (deg) | TEA Consumption (Kg/hr) |
|---|---|---|---|---|---|---|---|---|---|
| 1 | 91.5 | 1500 | 4.60 | 5.6 | 31.1 | 20 | 53.8 | 45 | 1.50 |
| 2 | 91.5 | 1500 | 5.00 | 5.6 | 31.1 | 20 | 53.8 | 45 | 1.68 |
| 3 | 122.0 | 1500 | 2.10 | 6.1 | 31.1 | 20 | 58.0 | 45 | 0.72 |
| 4 | 122.0 | 1500 | 4.90 | 6.2 | 31.1 | 20 | 58.0 | 45 | 1.67 |

Observations

Runs 1 and 2 show that even at a constant belt speed, increasing TEA chamber concentrations resulted in increased TEA consumption. On run No. 3, when the knife angle for the inlet knife was increased to 25°, the oxygen concentration in the chamber increased. At an inlet knife angle of 15°, the oxygen concentration in the chamber decreased only slightly. On run No. 4, when the exit knife was varied to an angle of 50° with an increased flow of 62.3 liters per minute, the oxygen concentration in the chamber did not vary. At the increased angle of 50° for the exit knife, at the same 53.8 liter per minute gas flow, the oxygen in the chamber increased. At the increased angle of the exit knife of 50°, an increase of the gas flow to 65.1 liters per minute resulted in no significant improvement of the oxygen concentration in the chamber.

TABLE 3

| Run No. | Belt Vel. (m/min) | Recycle (L/min) | Chamber (vol %) TEA | Chamber (vol %) $O_2$ | Inlet Knife Flow (L/min) | Inlet Knife Angle (deg) | Outlet Knife Flow (L/min) | Outlet Knife Angle (deg) | TEA Consumption (Kg/hr) |
|---|---|---|---|---|---|---|---|---|---|
| 1 | 30.5 | 1557 | 1.90 | 3.9 | 31.1 | 10 | 42.5 | 28 | 0.44 |
| 2 | 30.5 | 1557 | 2.25 | 3.5 | 31.1 | 10 | 42.5 | 27 | 0.62 |
| 3 | 30.5 | 1557 | 3.90 | 3.8 | 31.1 | 10 | 42.5 | 27 | 1.04 |
| 4 | 61.0 | 1557 | 1.90 | 4.0 | 31.1 | 10 | 42.5 | 45 | 0.54 |
| 5 | 91.5 | 1557 | 1.58 | 5.6 | 31.1 | 20 | 53.8 | 45 | 0.54 |
| 6 | 91.5 | 1557 | 2.30 | 5.0 | 31.1 | 20 | 53.8 | 45 | 0.82 |
| 7 | 91.5 | 1557 | 3.05 | 5.7 | 31.1 | 10 | 53.8 | 45 | 1.07 |
| 8 | 91.5 | 1557 | 3.37 | 5.7 | 31.1 | 20 | 53.8 | 45 | 1.14 |

Observations

The results of runs 1 and 4 show that with a doubling of the belt velocity, the TEA and oxygen concentration in the chamber can be maintained substantially the same by merely increasing the angle of the outlet gas knife.

TABLE 4

| Run No. | Belt Vel. (m/min) | Recycle (L/min) | Chamber (vol %) TEA | Chamber (vol %) $O_2$ | Inlet Knife Flow (L/min) | Inlet Knife Angle (deg) | Outlet Knife Flow (L/min) | Outlet Knife Angle (deg) | TEA Consumption (Kg/hr) |
|---|---|---|---|---|---|---|---|---|---|
| 1 | 24.4 | 1500 | 3.03 | 4.3 | 31.1 | 10 | 42.5 | 25 | 0.62 |
| 2 | 30.5 | 1557 | 3.30 | 3.8 | 31.1 | 10 | 42.5 | 25 | 0.83 |
| 3 | 61.0 | 1557 | 3.35 | 4.8 | 31.1 | 10 | 42.5 | 25 | 0.93 |
| 4 | 122.0 | 1557 | 1.80 | 6.0 | 31.1 | 20 | 59.5 | 45 | 0.62 |
| 5 | 122.0 | 1557 | 2.72 | 5.6 | 31.1 | 20 | 58.0 | 45 | 0.92 |
| 6 | 122.0 | 1840 | 2.76 | 5.5 | 31.1 | 20 | 58.0 | 45 | 0.92 |
| 7 | 122.0 | 1982 | 2.76 | 5.5 | 31.1 | 20 | 58.0 | 45 | 0.92 |
| 8 | 122.0 | 2265 | 2.73 | 6.0 | 31.1 | 20 | 58.0 | 45 | 0.92 |

TABLE 4-continued

| Run No. | Belt Vel. (m/min) | Recycle (L/min) | Chamber (vol %) TEA | Chamber (vol %) $O_2$ | Inlet Knife Flow (L/min) | Inlet Knife Angle (deg) | Outlet Knife Flow (L/min) | Outlet Knife Angle (deg) | TEA Consumption (Kg/hr) |
|---|---|---|---|---|---|---|---|---|---|
| 9 | 122.0 | 1840 | 3.99 | 5.8 | 31.1 | 20 | 59.5 | 45 | 1.36 |

Observations

Runs 5, 6, 7, and 8 maintained all variables constant but the recycle. These results demonstrate that the recycle can be increased to a level whereby the oxygen concentration in the chamber increases. Apparently, there is an optimum recycle for the chamber which results in a minimization of oxygen concentration therein, provided that all other variables remain essentially unchanged.

Based upon the data tabulated above and the experience garnered by operation of the prototype chamber, optimization of the inlet and outlet knife angles and flow rates have been determined based upon the conveyor speed. These optimized design variables assume the exhaust rate from cells 50 and 102 each will be about 425 L/min (15 SCFM) and the recycle flow rate through lines 120 and 122 will be less than 2265 L/min. With these conditions, and based upon the conveyor speed, the angle and flow rate through the knives will permit the oxygen concentration in the chamber to be maintained at less than 6%, generally 3–6%, and a constant TEA concentration maintained ranging up to about 5%.

TABLE 5

OPTIMUM SETTINGS AT VARIOUS BELT SPEEDS

| Conveyor Speed (m/min) | Inlet Knife Angle (°) | Inlet Knife Flow (L/min) | Outlet Knife Angle (°) | Outlet Knife Flow (L/min) |
|---|---|---|---|---|
| 15.25 | 10 | 31.1 | 20 | 36.8 |
| 24.40 | 10 | 31.1 | 25 | 42.5 |
| 30.50 | 10 | 31.1 | 25 | 42.5 |
| 61.00 | 10 | 31.1 | 40 | 42.5 |
| 91.50 | 20 | 31.1 | 45 | 53.8 |
| 122.00 | 20 | 31.1 | 45 | 58.8 |

As will be noted, the $N_2$ flow rate and knife angle of the outlet knife appears to be more important in maintaining the TEA and oxygen balance within the system.

While the data tabulated in Tables 1–4 above provide an accurate operating history of the prototype chamber, such data can be assembled and correlated to provide interesting and valuable information concerning the total TEA consumption and total nitrogen consumption for the chamber. This information is presented as a function of the belt speed and as a function of chamber concentration of TEA.

TABLE 6

Total $N_2$ Consumption (L/min)

| Belt Speed (m/min) | TEA Chamber Concentration (vol %) 1 | 2 | 3 | 4 | 5 | Avg. |
|---|---|---|---|---|---|---|
| 24.4 | 112.13 | 112.41 | 111.28 | 110.43 | 110.15 | 111.27 |
| 30.5 | 117.51 | 117.23 | 116.66 | 115.81 | 115.25 | 116.49 |
| 61.0 | 131.39 | 130.82 | 130.25 | 128.84 | 128.27 | 129.91 |
| 91.5 | 150.92 | 150.07 | 149.51 | 148.09 | 147.53 | 149.23 |
| 122.0 | 159.42 | 158.57 | 158.00 | 156.59 | 155.74 | 157.66 |

TABLE 7

TEA Consumption (Kg/hr)

| TEA Chamber Conc. (vol %) | Belt Speed (m/min) 24.4 | 30.5 | 61.0 | 91.5 | 122.0 |
|---|---|---|---|---|---|
| 1.0 | 0.21 | 0.25 | 0.29 | 0.33 | 0.34 |
| 1.6 | 0.34 | — | — | 0.54 | — |
| 1.8 | — | — | — | — | 0.62 |
| 1.9 | — | 0.44 | 0.54 | — | — |
| 2.0 | 0.41 | 0.51 | 0.57 | 0.67 | 0.68 |
| 2.1 | — | — | — | — | 0.72 |
| 2.3 | — | 0.62 | — | 0.79 | — |
| 2.7 | — | — | — | — | 0.92 |
| 2.9 | — | — | — | 0.98 | — |
| 3.0 | 0.62 | 0.77 | 0.85 | 1.01 | 1.12 |
| 3.3 | — | 0.83 | —.93 | — | — |
| 3.4 | — | — | — | 1.1 | — |
| 3.9 | — | 1.04 | — | — | 1.36 |
| 4.0 | 0.83 | 1.03 | 1.13 | 1.34 | — |
| 4.6 | — | — | — | 1.50 | — |
| 5.0 | 1.04 | 1.28 | 1.42 | 1.68 | 1.70 |

Figure 5:
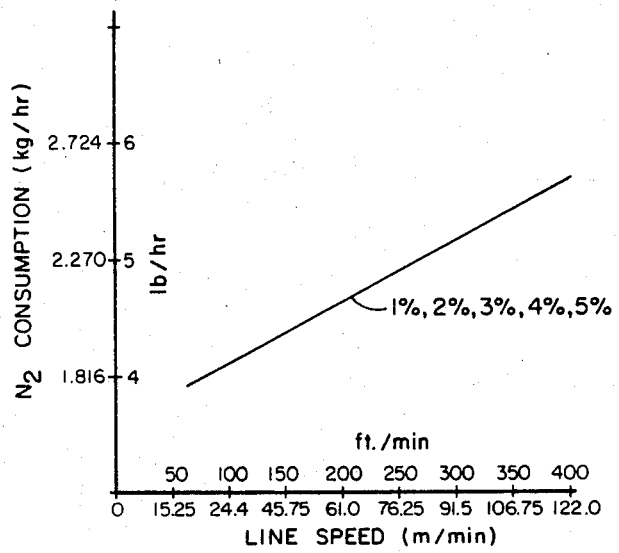
FIG. 5 graphically plots nitrogen gas consumption of the prototype curing chamber as a function of conveyor belt speed for various constant TEA chamber concentrations.
Figure 6:
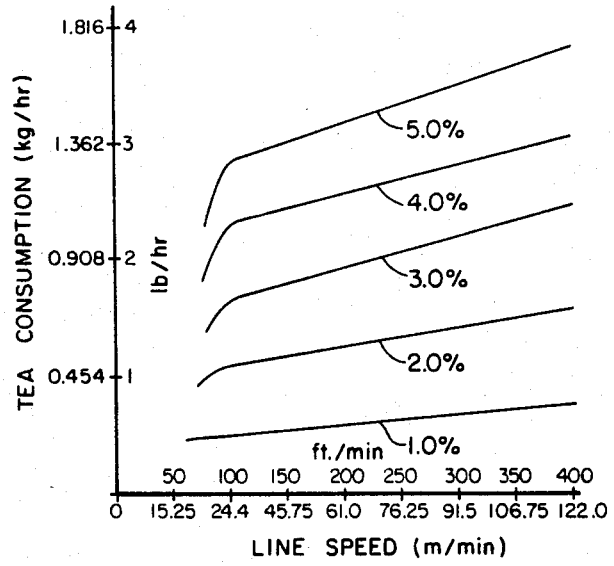
FIG. 6 graphically plots TEA consumption of the prototype curing chamber as a function of conveyor belt speed for various constant TEA chamber concentrations.
Figure 7:
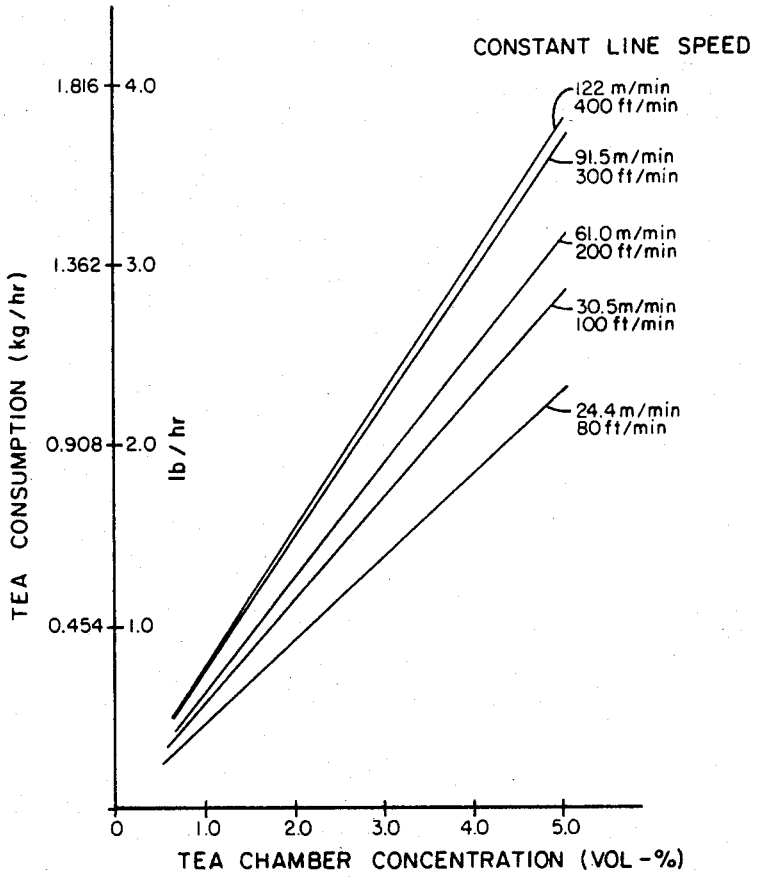
FIG. 7 graphically plots TEA consumption for the prototype curing chamber at constant TEA chamber concentrations for various constant conveyor belt speeds.

The above-tabulated data also is depicted graphically in FIGS. 5–7. FIG. 5 graphically depicts the nitrogen consumption as a function of belt speed at various constant TEA chamber concentrations. As can be seen from the data in Table 5, the nitrogen consumption primarily is a function of the belt speed and appears to be substantially independent of the TEA concentration in the chamber. It should be noted that the amount of nitrogen required to maintain central zone 34 at a desired oxygen concentration can be supplied manually through lines 137 and 122 into zone 34. The overall consumption of nitrogen, though, remains substantially constant at the varying concentrations of TEA within the chamber. FIG. 6 graphically depicts the consumption of TEA as a function of the belt speed at various constant TEA chamber concentrations. Quite clearly the increased TEA consumption at increased TEA chamber concentrations is seen. Also, the TEA consumption is increased at increased belt speeds and such TEA consumption increases at a greater rate at higher TEA chamber concentrations for increasing belt speeds.

FIG. 8 graphically depicts the TEA consumption as a function of TEA chamber concentration at various constant line speeds. The TEA consumption is shown to be essentially linearly related to the chamber concentration and appears to asymptotically approach a maximum consumption based upon line speed.

The foregoing data demonstrates the remarkable efficiency and economy of the design of the chamber of the present invention. Also, the apparent important variables in chamber design have been identified qualitatively and quantitatively. It will be appreciated that various modifications of the chamber can be implemented without departing from the philosophy and scope of the present invention.

It will be appreciated that the nature of the gas environment through the central flow zone merely can be heated air or can be simply a carrier gas (e.g. nitrogen, carbon dioxide, or the like). Appropriate insulation or lagging of the chamber may be required under such circumstances if heat transfer is of prime concern. Materials of construction are conventional for the type of operation contemplated. Thus, stainless steel, galvanized steel, glass-lined steel or the like is used as is necessary, desirable, or convenient in conventional fashion. Where erosion or corrosion is inconsequential, mild steel, aluminum or the like may be used. Alternatively, the carrier gas can bear a catalyst such as a vaporous tertiary amine catalyst. For practice of vapor permeation cure with the chamber of the present invention, a good discussion on various types of vapor permeation curable coating compositions can be found in commonly assigned U.S. Pat. application Ser. No. 474,156, filed Mar. 10, 1983, the disclosure of which is expressly incorporated herein by reference. Such copending application describes and references a variety of polyols, multi-isocyanates, and optional solvents for formulating vapor permeation curable coatings. In this application, all percentages of gaseous components are volume percentage and all units are in the metric system, unless otherwise expressly indicated.

I claim:

1. A chamber which defines a constant gas flow of passing objects therethrough carried by a conveyor, which comprises an elongate housing having an inlet opening and an outlet opening in the longitudinal direction and a moving conveyor which runs the length of said housing for transporting objects from said inlet opening through said housing and thereout through the outlet opening, the space above said conveyor comprising an inlet zone, a central gas zone, and an outlet zone, said inlet zone comprising an outer adjustable gate for determining said inlet opening, a central inlet baffle gate, and an inner inlet adjustable deflector wall, the space between said outer gate and said baffle gate being connected to exhaust means, the space between said baffle gate and said deflector wall being a modulating gas cell and containing a gas knife connected to a source of inert gas and capable of injecting said inert gas at an adjustable angle onto said conveyor substantially its entire width;

said outlet zone comprising an outer adjustable gate for determining said outlet opening, a central outlet baffle gate, and an inner adjustable outlet deflector wall, the space between said outer gate and said baffle gate being connected to exhaust means, the space between said baffle gate and said deflector wall being a modulating gas cell and containing a gas knife connected to a source of inert gas and capable of injecting said inert gas at an adjustable angle onto said conveyor substantially its entire width; and said central gas zone having withdrawal means located in proximity to said inlet deflector wall which withdrawal means are connected to recirculating means for passing gaseous flow back into said central gas zone in a location in proximity to said inner outlet deflector wall, said inlet and outlet deflector walls being sloped downwardly and inwardly within said central gas zone.

2. The chamber of claim 1 wherein for said inlet zone and for said outlet zone, said outer adjustable gates and said central baffle gates are footed.

3. The chamber of claim 1 wherein a plate below said conveyor bisects said housing for additionally forming an enclosed space below said conveyor, the return loop of said conveyor passing through said enclosed below space, said below closed space being connected to a source of exhaust for exhausting gaseous substances therein.

4. The chamber of claim 1 wherein said inlet and outlet deflector walls are curvilinear.

5. The chamber of claim 1 wherein said inlet and outlet gas knives are adjustable to flow inert gas onto said conveyor at an angle ranging from between about 0° and 50°.

6. The chamber of claim 1 wherein the flow rate of inert gas to both gas knives are independently adjustable.

7. The chamber of claim 1 wherein make-up gas for said central gas zone is admitted to said recirculating means for passing back into said central gas zone.

8. The chamber of claim 1 wherein said gas flow in said central gas zone comprises a vaporous tertiary amine catalyst carried by an inert gas for curing vapor permeation curable coatings on objects passed through said chamber.

9. The chamber of claim 1 having inert gas make-up means connected to said central gas zone for maintaining the pressure therein to be slightly higher than the pressure in said inlet zone and said outlet zone.

10. In a chamber which defines a constant gas flow environment for passing objects therethrough carried by conveying means, said chamber of the type having an inlet zone and an outlet zone which retard air from passing into a centrally disposed gas flow environment and which retard said constant gas flow environment from passing out of said chamber, the improvement in said inlet and said outlet zones which comprises said inlet zone comprising an outer adjustable gate for determining said inlet opening, a central inlet baffle gate, and an inner adjustable inlet gate, the space between said outer gate and said central baffle gate being connected to exhaust means, the space between said baffle gate and said inner adjustable gate being a modulating gas cell and containing a gas knife connected to a source of inert gas and capable of injecting said inert gas at an adjustable angle onto said conveying means substantially its entire width; and said outlet zone comprising an outer adjustable gate for determining said outlet opening, a central outlet adjustable baffle gate, and an inner adjustable outlet gate, the space between said outer gate and said baffle gate being connected to exhaust means, the space between said baffle gate and said inner gate being a modulating gas cell and containing a gas knife connected to a source of inert gas and capable of injecting said inert gas at an adjustable angle onto said conveying means substantially its entire width.

11. The improved chamber of claim 10 wherein said inlet and outlet outer adjustable gates and central baffle gates are footed.

12. The improved chamber of claim 10 wherein said inlet and outlet central inlet baffle gates are adjustable.

13. The improved chamber of claim 10 wherein said inlet and outlet gas knives are adjustable at an angle ranging from between about 10° and 50°.

14. The improved chamber of claim 10 wherein the pressure in said inlet space between said outer gate and said central baffle gate and the pressure in said outlet zone space between said outer gate and said central baffle gate are maintained at substantially the same pressure which pressure is less than atmospheric pressure.

15. The improved chamber of claim 10 wherein said constant gas flow environment comprises a vaporous tertiary amine catalyst carried by an inert gas for vapor permeation curing of vapor permeation curable surface coatings.

* * * * *